United States Patent [19]

Suzuki

[11] Patent Number: 4,679,480

[45] Date of Patent: Jul. 14, 1987

[54] TONE SIGNAL GENERATION DEVICE FOR CHANGING THE TONE COLOR OF A STORED TONE WAVESHAPE IN AN ELECTRONIC MUSICAL INSTRUMENT

[75] Inventor: Hideo Suzuki, Hamamatsu, Japan

[73] Assignee: Nippon Gakki Seizo Kabushiki Kaisha, Hamamatsu, Japan

[21] Appl. No.: 770,308

[22] Filed: Aug. 27, 1985

[30] Foreign Application Priority Data

Aug. 31, 1984 [JP] Japan ..... 59-180429

[51] Int. Cl.[4] ..... G10H 1/12; G10H 7/00

[52] U.S. Cl. ..... 84/1.22; 84/1.1; 84/DIG. 9; 84/DIG. 10

[58] Field of Search ..... 84/1.01, 1.03, 1.11–1.13, 84/1.19–1.27, DIG. 9, DIG. 10

[56] References Cited

U.S. PATENT DOCUMENTS

| | | | |
|---|---|---|---|
| 4,130,043 | 12/1978 | Niimi | 84/1.03 |
| 4,200,021 | 4/1980 | Chibana | 84/1.22 |
| 4,224,856 | 9/1980 | Ando et al. | 84/1.19 |
| 4,352,312 | 10/1982 | Whitefield et al. | 84/1.21 |
| 4,383,462 | 5/1983 | Nagai et al. | 84/1.26 |
| 4,566,364 | 1/1986 | Katoh | 84/1.19 |

*Primary Examiner*—S. J. Witkowski

*Attorney, Agent, or Firm*—Spensley Horn Jubas & Lubitz

[57] ABSTRACT

A first waveshape memory stores a full waveshape of a tone from the start to the end of sounding of the tone or a portion thereof in plural periods. A second waveshape memory stores waveshape data of a modification waveshape for the full waveshape or the portion thereof. A tone waveshape signal read out from the first waveshape memory and a modification waveshape signal read out from the second waveshape memory are both multiplied with respective coefficients whereby these waveshape signals are weighted. These weighted waveshape signals are added together to provide a mixed tone signal. By controlling the coefficients, the tone color imparted on the mixed signal is variously determined. The coefficients for the tone color control are provided in accordance with key scaling, key touch or operation states of control knobs. Thus, tone signals having a variety of tone color changes can be realized without the necessity of many wave memories.

9 Claims, 8 Drawing Figures

TONE SIGNAL GENERATION DEVICE FOR CHANGING THE TONE COLOR OF A STORED TONE WAVESHAPE IN AN ELECTRONIC MUSICAL INSTRUMENT

BACKGROUND OF THE INVENTION

This invention relates to a tone signal generation device of a waveshape memory reading type and, more particularly, to a tone signal generation device capable of generating a high-quality tone signal by accessing a waveshape memory storing a full or partial waveshape in plural periods from the start of sounding of a tone to the end thereof.

Known in the art is a tone signal generation device capable of generating a high-quality tone simulating closely a tone of an acoustic musical instrument by storing a full or partial waveshape in plural periods from the start of sounding of a tone to the end thereof in a waveshape memory and accessing this waveshape memory (e.g., U.S. Pat. No. 4,383,462).

Since this prior art tone generation device reads out a full waveshape or a partial waveshape stored in the waveshape memory and provides the read out waveshape directly as a tone signal, a tone color change of a generated tone tends to lack in variation and therefore leaves something to be improved musically. If, in order to improve this defect, the tone generation device is provided with a key scaling control in which a tone color is changed in accordance with a tone pitch or a tone range of a tone to be generated, a touch response control in which the tone color is changed in accordance with an operating manner of a playing key such as a depression speed and a depression strength, and an operator control in which the tone colors are changed in accordance with an operation manner of various control knobs, a plurality of waveshape memories must be provided and one of them must be selected for reading for effecting these controls with a resulting complicated construction of the device and requirement for a tremendous memory capacity of the waveshape memories.

The present invention, therefore, aims to solve the problem in the tone signal generation device generating a high-quality tone signal that the attempt for introducing a tone color change control such as the key scaling control is inevitably accompanied by a complicated construction of the device and the problem that the waveshape memory requires a tremendous amount of memory capacity.

It is an object of the invention to provide a tone signal generation device capable of imparting the tone color change such as the key scaling with a simple construction using a waveshape memory of a relatively small capacity.

SUMMARY OF THE INVENTION

The tone signal generation device according to the invention comprises basic tone signal generation means including a first waveshape memory storing high-quality waveshape data of plural periods and modification waveshape generation means including a second waveshape storing waveshape data of a modification waveshape for a full or partial waveshape of plural periods from the start of sounding of a tone to the end thereof. Waveshape data is read out from each of the two memories in accordance with the tone pitch of a tone to be generated and, in accordance with the waveshape data, a basic tone signal and a modification waveshape signal are generated by the respective generation means. These basic tone signals and modification waveshape signals are individually weighted by separate weighting coefficients corresponding to tone color change parameters. By combining the weighted two signals electrically or acoustically, a tone signal having a desired tone color change is formed.

The first waveshape memory prestores a full waveshape or a partial waveshape in plural periods (these plural periods may be either continuous or intermittent) from the start of sounding of a tone to the end thereof and the basic tone signal which is generated on the basis of this waveshape data exhibits its proper, high-quality tone color characteristics. On the other hand, the second waveshape memory stores waveshape data of a modification waveshape for the waveshape stored in the first waveshape memory and, by combining the modification waveshape signal generated on the basis of the modification waveshape data with the basic tone signal at a suitable ratio determined by their corresponding weighting coefficients, a tone in which the proper tone color characteristics of the basic tone signal are modified in accordance with the modification waveshape signal is finally obtained.

According to the present invention, therefore, proper tone color characteristics of a high-quality basic tone signal are subtly variably controlled in response to tone color change parameters such as key scaling, key touch and operated state of a control knob. The degree of the tone color change is determined by the weighting coefficients. If, for example, the weighting coefficient of the basic tone signal is large and the one of the modification waveshape signal is small, the tone color change from the proper tone color characteristics of a finally obtained tone is small and vice versa. Since it is not an object of the invention to change the proper tone color characteristics themselves, tone signals having proper tone color characteristics corresponding to individual tone color kinds (e.g., piano, flute etc.) which can be selected by a tone color selection switch can be selectively generated by storing waveshape data for the respective tone colors individually in the first waveshape memory. In the second waveshape memory also, waveshape data for these tone colors may preferably be stored individually.

The modification waveshape generation means preferably includes tone color changing means for changing a modification waveshape having been read out or to be read out from the second waveshape memory in response to the tone color change parameters. By the provision of such means, the tone color change can be controlled in an even more complicated manner.

According to the present invention, in generating a high-quality tone signal in response to waveshape data read out from a waveshape memory storing waveshape data of plural periods, storing of waveshape data individually for each tone color change parameter is unnecessary so that there is no problem of requirement for a waveshape memory of a large capacity and the construction of the device can therefore be simplified.

Preferred embodiments of the invention will now be described in conjunction with the accompanying drawings.

BRIEF DESCRIPTION OF THE DRAWINGS

In the accompanying drawings,

FIGS. 1 and 2 show an embodiment of the tone signal generation device according to the invention in which FIG. 1 is a block diagram showing an internal construction of a tone generator of FIG. 2 and FIG. 2 is a block diagram showing the entire construction of an electronic musical instrument to which this invention has been applied;

FIGS. *3a*, *3b* and *3c* are graphs showing respectively an example each of touch data, envelope signal and key scaling data used in the embodiment of FIG. 2.

DESCRIPTION OF PREFERRED EMBODIMENTS

Figure 1:
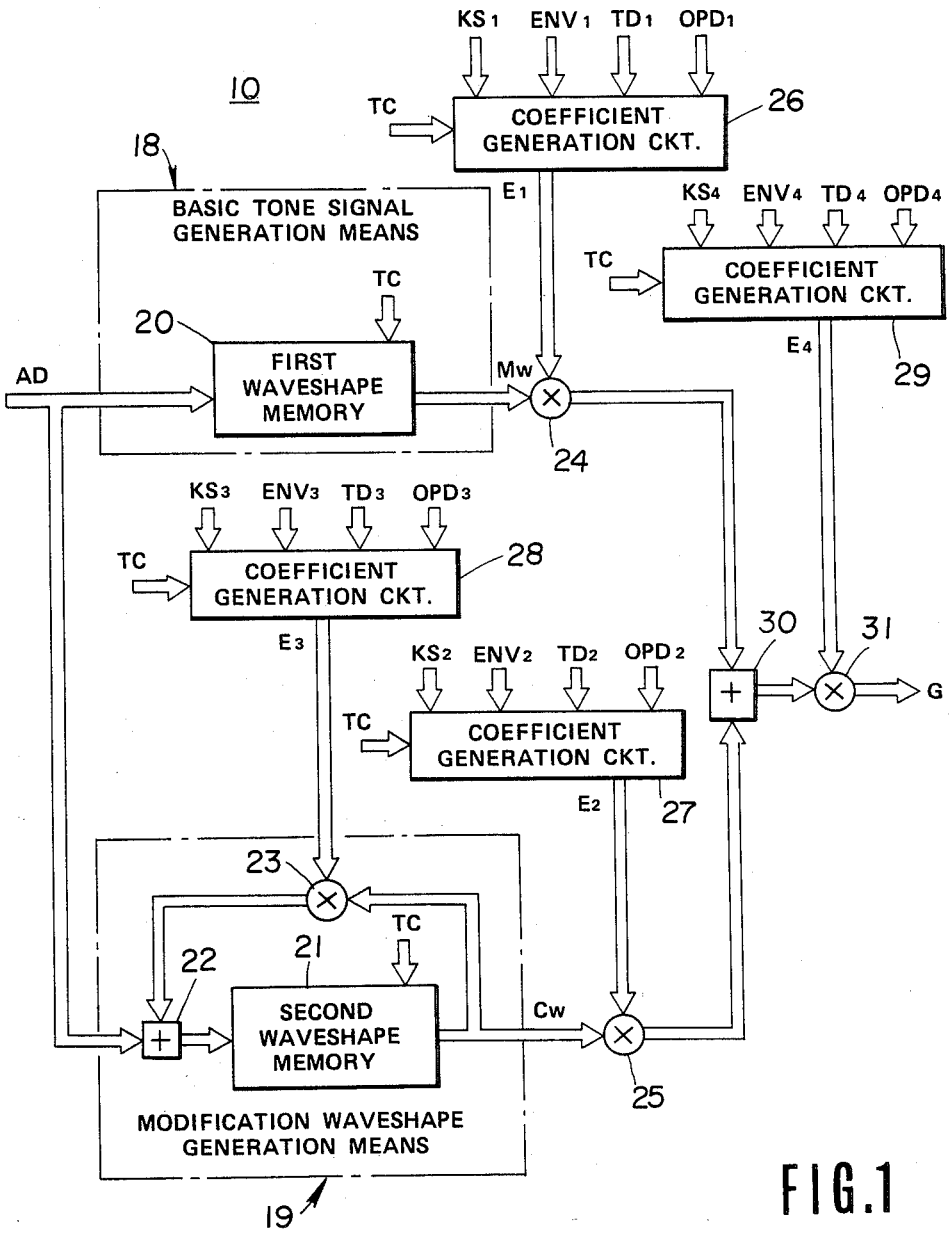
Figure 2:
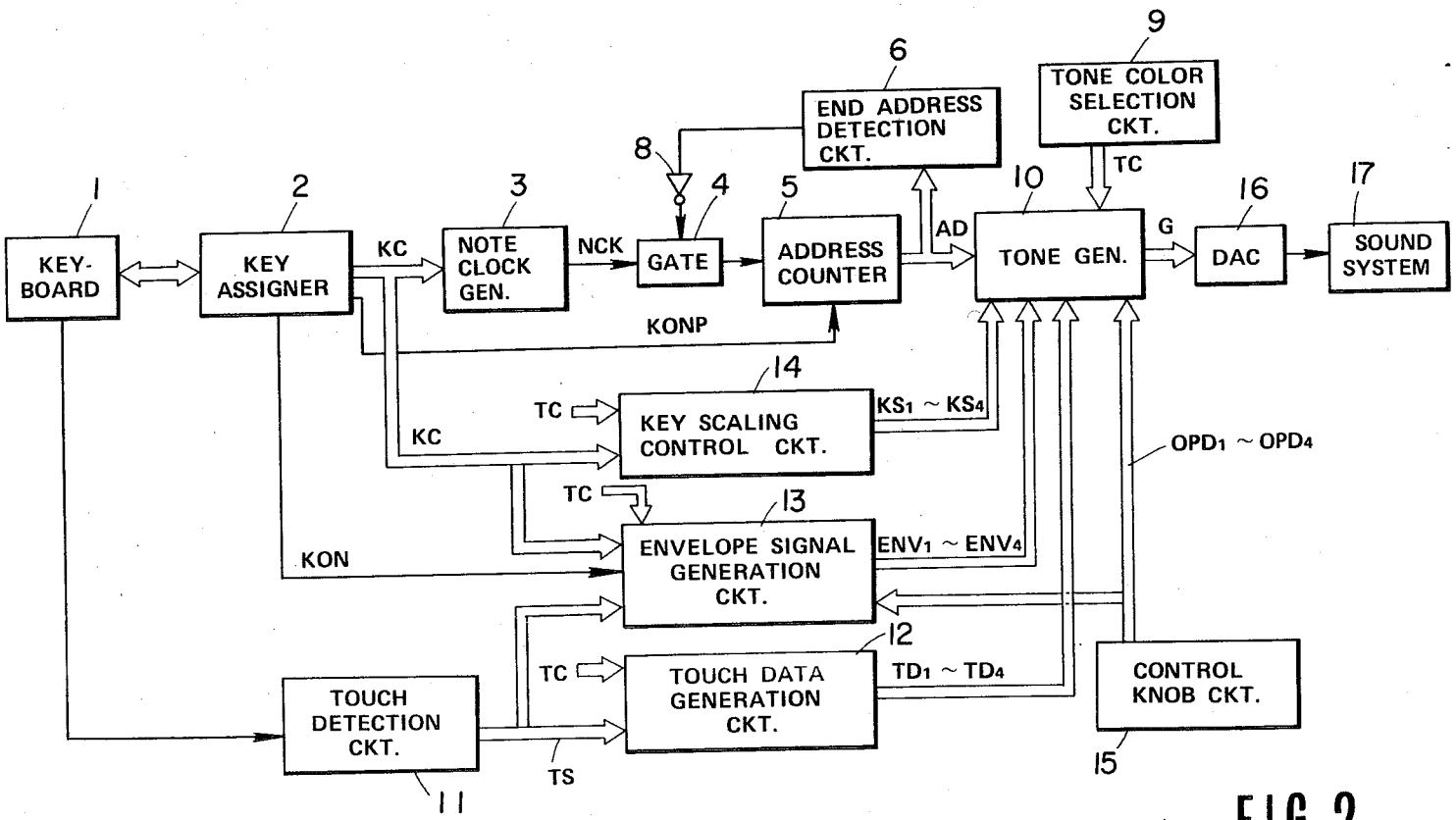

FIG. 2 is a block diagram showing the entire construction of an electronic musical instrument to which this invention has been applied and an example of an internal construction of a tone generator 10 shown there is illustrated in FIG. 1. The feature of the invention is illustrated mainly in FIG. 1.

Referring first to FIG. 2, the entire construction of the electronic musical instrument incorporating this example will be described.

The electronic musical instrument has a plurality of time division tone generation channels and is capable of generating simultaneously tones corresponding to plural depressed keys by assigning the depressed keys on a keyboard to available ones among these time division tone generation channels. In FIG. 2, a keyboard 1 has keys for designating tone pitches of tones to be generated. A key assigner 2 detects depressed key or keys on the keyboard 1, assigns key codes KC corresponding to the depressed keys to available ones of the time division tone generation channels (hereinafter referred to simply as "tone generation channels") and outputs these key codes KC at timings synchronized with the assigned channels on a time shared basis. Simultaneously with the assignment of the key codes KC corresponding to the depressed keys, the key assigner 2 produces a key-on signal KON which keeps logic "1" during a period until the depressed keys are released in synchronism with the assigned channels and, when key code KC for a newly depressed key has been assigned to any of the tone generation channels, produces a key-on pulse KONP (a "1" signal) with a short pulse width at a timing synchronized with the channel to which the newly depressed key has been assigned.

A note clock generator 3 produces, responsive to the key code KC produced by the key assigner 2, a note clock signal NCK of a frequency corresponding to the depressed key with respect to each of the tone generation channels on a time shared basis. A gate 4 selectively delivers the note clock signal NCK. An address counter 5 counts the note clock signals NCK applied through the gate 4 with respect to each of the tone generation channels to form address signals AD of a waveshape memory in a tone generator 10 to be described later. This address counter 5 has count channels corresponding to the tone generation channels and counts, in corresponding count channels, the note clock signals NCK applied from the note clock generator 3 via gate 4 at timings corresponding to the respective tone generation channels, delivering out counts in the respective count channels as the address signals AD of the waveshape memory on a time shared basis.

In the respective count channels, preceding counts are reset by the key-on pulse KONP produced by the key assigner 2 when a newly depressed key has been assigned to the corresponding tone generation channels and a new counting operation is started from this reset value.

An end address detection circuit 6 detects whether or not the address signal AD for each tone generation channel produced by the address counter 5 has reached a last address value in the waveshape memory. When the address signal AD has reached the last address in the waveshape memory, the circuit 6 supplies an inhibit signal to the gate 4 at a time division timing of this address signal AD to cease the counting operation in the count channel in the address counter 5 in which the count has reached the last address value.

A tone color selection circuit 9 selects a desired tone color such as piano and violin and produces, upon selection, tone color selection information TC representing the selected tone color.

The tone generator 10 comprises a waveshape memory storing waveshape information about the entire waveshape from the start of generation of a tone to the end thereof with respect to each tone color which can be selected by the tone color selection circuit 9 and generates tone signals G corresponding to the tone pitches of the depressed keys by reading out waveshape information stored in this waveshape memory by the address signals AD provided by the address counter 5. As described above, the tone generator 10 has tone generation channels corresponding to the number of tones which can be simultaneously produced. These tone generation channels are constructed by using the circuit including the waveshape memory on a time shared basis.

A touch detection circuit 11 detects the depression speed (touch speed) or depression strength (touch strength) with respect to a key depressed on the keyboard 1 and produces touch information TS representing such depression speed or strength. A touch data generation circuit 12 generates, responsive to the touch information TS provided by the touch detection circuit 11 and the tone color selection information TC provided by the tone color selection circuit 9, touch data TD of characteristics suited to the selected tone color in accordance with the touch information TS. In the present embodiment, touch data $TD_1$–$TD_4$ of four channels are produced.

An envelope signal generation circuit 13 generates an envelope signal ENV for changing in a timewise fashion the tone color and amplitude of the tone signal G formed in each tone generation channel from the rise to the fall thereof, starting its operation in response to the key-on signal KON produced by the key assigner 2. The envelope signal ENV produced in this circuit has a different waveshape depending upon the selected tone color represented by the tone color selection information TC and is delivered out as envelope signals $ENV_1$–$ENV_4$ of four channels for each selected tone color.

A key scaling control circuit 14 generates, responsive to the key code KC produced by the key assigner 2 and the tone color selection information TC produced by the tone color selection circuit 9, key scaling information KS for controlling the tone color and amplitude of the tone signal G generated in each tone generation channel in accordance with the tone range and the selected tone color of the depressed key. In the same manner as in the above described circuits 12 and 13, the key scaling control circuit 14 produces key scaling information $KS_1$–$KS_4$ of four channels.

A control knob circuit 15 has control knobs for controlling tone colors, tone volume and other musical tone elements for controlling brightness of the tone and produces control knob information OPD corresponding to operated states of these control knobs. This circuit likewise produces control knob information $OPD_1$–$OPD_4$ of four channels.

A digital-to-analog converter 16 converts the digital tone signals G for the respective tone generation channels formed in the tone generator 10 to analog tone signals to sound them as musical tones from a sound system 17.

The touch data generation circuit 12, the envelope signal generation circuit 13 and the key scaling control circuit 14 respectively produce, at time division timings corresponding to the respective tone generation channels, touch data $TD_1$–$TD_4$, key scaling information $KS_1$–$KS_4$ and envelope signals $ENV_1$–$ENV_4$ respectively of four channels for controlling the tone color and amplitude of the tone signal G with respect to each of the tone generation channels. Examples of the touch data $TD_1$–$TD_4$ generated by the touch data generation circuit 12, the envelope signal $ENV_1$–$ENV_4$ produced by the envelope signal generation circuit 13 and the key scaling information $KS_1$–$KS_4$ produced by the key scaling control circuit 14 are shown respectively in FIGS. 3*a*, 3*b* and 3*c*. In these examples, data output characteristics of the circuits 12 to 14 differ depending upon the tone color represented by the tone color selection information TC.

As shown in FIG. 1, the tone generator 10 comprises basic tone signal generation means 18 including a first waveshape memory 20 and modification waveshape generation means 19 including a second waveshape memory 21. In the present embodiment, it is assumed that the first waveshape memory 20 stores waveshape data concerning a full waveshape from the start of sounding of a tone to the end thereof in a pulse-code modulation (PCM) system, storing one set of waveshape data individually for each of tone colors which can be selected by a tone color selection circuit 9. The second waveshape memory 21 stores modification waveshape for a full waveshape of a tone from the start of sounding of the tone to the end thereof (i.e., a full waveshape to be added for modification from the start of sounding of the tone to the end thereof) similarly in the PCM system individually for each of the tone colors. The modification waveshape herein means not a waveshape which can realize proper tone color characteristics themselves which can be selected by tone color selection information TC (such as the waveshape stored in the first waveshape memory) but a waveshape which is suitable for imparting a tone color change to a waveshape having such proper tone color characteristics.

The tone color selection information TC is applied to the respective waveshape memories 20 and 21 to designate a set of waveshape data to be read out from these memories 20 and 21 in accordance with a selected tone color. In the respective waveshape memories 20 and 21, the set of waveshape data designated by the tone color selection information TC is sequentially read out at each sample point in response to an address signal applied to the address input. The address signal AD provided by an address counter 5 (FIG. 2) is applied directly to the address input of the first waveshape memory 20 and to the address input of the second waveshape memory 21 through an adder 22.

The modification waveshape generation means 19 includes, as tone color changing means for changing the modification waveshape to be read out from the second waveshape memory 21 in response to a tone color change parameter, the adder 22 and a multiplier 23. For feeding back the output signal of the waveshape memory 21 at a rate corresponding to the tone color change parameter, the multiplier 23 is provided for receiving the output signal of the waveshape memory 21, multiplying it by a coefficient $E_3$ and applying the result of multiplication to the adder 22. The adder 22 modulates the address signal AD by the memory output signal fed back through the multiplier 23 and supplies the modulated address signal to the address input of the waveshape memory 21. Thus, the address signal for accessing the second waveshape memory 21 is modulated by the read out output signal of the waveshape memory 21 itself whereby an effect equivalent to the frequency modulation is obtained. By this modulation, the modification waveshape formed on the basis of the waveshape data read out from the waveshape memory 21 becomes different from the modification waveshape which is originally stored in the memory 21 and a tone color change caused by changing the modification waveshape itself is realized. The degree of the change in the modification waveshape is determined by the modulation factor and this modulation factor is controlled by the coefficient $E_3$ which sets the amount of the feedback. The modulation of the address signal AD of such feedback type becomes a complicated modulation since a further modulation by a modulated signal (i.e., the read out output signal of the waveshape memory 21) is performed. When the modulation factor is zero (i.e., the coefficient $E_3$ is zero), waveshape data which realizes the modification waveshape stored in the waveshape memory 21 is read out and, as the modulation factor is increased (i.e., the coefficient $E_3$ is increased), waveshape data which realizes modification waveshape containing more abundant harmonic components is read out.

The waveshape data read out from the first waveshape memory 20 is provided from the basic tone signal generation means 18 as a basic tone signal Mw and applied to a multiplier 24 for weighting. The waveshape data read out from the second waveshape memory 21 is provided from the modification waveshape generation means 19 as a modification waveshape signal Cw and applied to a multiplier 25 for weighting. Weighting coefficients $E_1$ and $E_2$ generated individually by coefficient generation circuits 26 and 27 are applied to the multipliers 24 and 25 and the input signals Mw and Cw are weighted by these coefficients $E_1$ and $E_2$ (i.e., the amplitudes are controlled).

Coefficient generation circuits 26 and 27 are provided for generating weighting coefficients $E_1$ and $E_2$ in response to various tone color change parameters. Among the touch data $TD_1$–$TD_4$, envelope signals $ENV_1$–$ENV_4$, key scaling information $KS_1$–$KS_4$ and control knob information $OPD_1$–$OPD_4$ produced by the circuits 12–15, data $TD_1$, $ENV_1$, $KS_1$ and $OPD_1$ are applied to the circuit 27. To the coefficient generation circuit 28 for generating the feedback coefficient $E_3$ are applied, as the tone color change parameters, data $TD_3$, $ENV_3$, $KS_3$ and $OPD_3$ and, responsive thereto, the coefficient $E_3$ is generated. Further, to a coefficient generation circuit 29 to be described later are applied, as the amplitude control parameters, data $TD_4$, $ENV_4$, $KS_4$ and $OPD_4$ and, responsive thereto, the amplitude coefficient $E_4$ is generated. These coefficient generation circuits 26–29 are constructed of operation circuits such as addition circuits or coefficient memories or a combination thereof and generate the coefficients $E_1$–$E_4$ as functions of the respective parameters $TD_1$–$TD_4$, $ENV_1$–$ENV_4$, $KS_1$–$KS_4$ and $OPD_1$–$OPD_4$. The tone color selection information TC may be applied to the respective circuits 26–29 as shown in the dotted line so as to change the contents of the coefficients $E_1$–$E_4$ in response to the tone color.

The basic tone signal Mw and modification waveshape signal Cw which have been weighted by the multipliers 24 and 25 are added in an adder 30 and a tone signal imparted with a desired tone color change corresponding to the tone color change parameters is outputted. The tone signal outputted from the adder 30 is applied to a multiplier 31 in which its amplitude (volume) is controlled in accordance with the amplitude coefficient $E_4$. The output of this multiplier 31 is provided from the tone generator 10 as the tone signal G.

All these circuits 20–31 constituting the tone generator 10 operates on the time shared basis, forming the tone signals G assigned to the respective tone generation channels in time division.

The degree of the tone color change is basically determined by the weighting coefficients $E_1$ and $E_2$. For example, the larger the weighting coefficient $E_1$ of the basic tone signal Mw and the smaller the weighting coefficient $E_2$ of the modification waveshape signal, the smaller is the tone color change from the proper tone color characteristics in the finally obtained tone signal G, and vice versa. In addition to this, the degree of the tone color change is controlled by the coefficient $E_3$ for the tone color change control in the modification waveshape generation means 19.

Figure 3A:
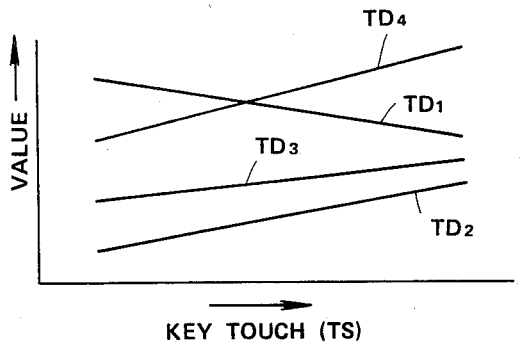
Figure 3B:
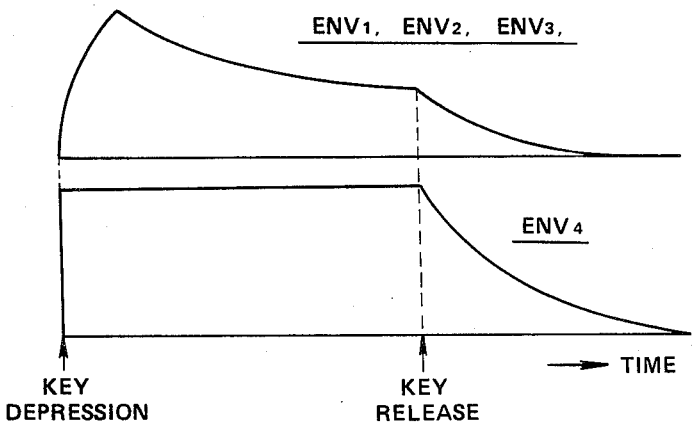
Figure 3C:
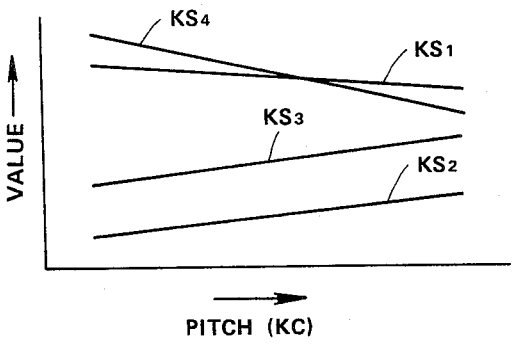

If, for example, the key scaling information $KS_1$–$KS_4$ are generated with characteristics as shown in FIG. 3*c* and the coefficients $E_1$–$E_4$ are also generated with characteristics corresponding thereto, in a weighting control by the coefficients $E_1$ and $E_2$ corresponding to data $KS_1$ and $KS_2$, the ratio of the basic tone signal Mw decreases and that of the modification waveshape signal Cw increases as the tone pitch of the tone to be generated rises so that the tone color change increases. In the feedback control by the coefficient $E_3$ corresponding to the data $KS_3$, the amount of feedback increases and the modulation factor thereby increases as the tone pitch rises so that harmonic components of the modification waveshape signal increase. In the level control by the coefficient $E_4$ corresponding to the data $KS_4$, key scaling which matches hearing in such a manner that the level decreases as the tone pitch rises is realized.

If the touch data $TD_1$–$TD_4$ are generated with characteristics as shown in FIG. 3*a* and the coefficients $E_1$–$E_4$ are also generated with characteristics corresponding thereto, the weighting control by the weighting coefficients $E_1$ and $E_2$ corresponding to the data $TD_1$ and $TD_2$ is made in such a manner that the ratio of the basic tone signal Mw decreases and that of the modification waveshape signal Cw increases as the key touch becomes stronger so that the tone color change increases. In the control by the coefficient $E_4$ corresponding to the data $TD_4$, harmonic components of the modification waveshape signal increase as the key touch becomes stronger. Further, in the level control by the coefficient $E_4$ corresponding to the data $TD_4$, the level increases as the key touch becomes stronger.

If the envelope signals $ENV_1$–$ENV_4$ are generated with characteristics as shown in FIG. 3*b* and the coefficients $E_1$–$E_4$ are also generated with characteristics corresponding thereto, the respective coefficients $E_1$, $E_2$ and $E_3$ have attack and decay characteristics which change timewise as shown in FIG. 3*b*. Accordingly, the ratio of weighting and the amount of feedback are controlled in accordance with the rise and fall of the tone and the tone color change corresponding thereto is realized. In the figure, the envelope signals $ENV_1$–$ENV_3$ are illustrated as having the same shape for the sake of convenience. The envelope signals can have their own shapes by independently controlling the attack time, attack level, sustain level, decay level and decay time. The envelope signal $ENV_4$ corresponding to the amplitude coefficient $E_4$ maintains a constant level during the depression of a key as shown in FIG. 3*b* because the basic tone signal and modification waveshape signal have been imparted with the level envelope of at least the attack portion.

As regards the control knob information $OPD_1$–$OPD_4$, corresponding coefficients $E_1$–$E_4$ are generated in the same manner as described above and the tone color change control and the level control corresponding thereto are performed.

A more complicated variation in the tone color can be achieved by applying, as shown by a dotted line in FIG. 2, the key code KC, touch information TS, control knob information $OPD_1$–$OPD_4$ to the envelope signal generation circuit 13 and suitably changing the rise time and decay time and levels of respective portions of the envelope signals $ENV_1$–$ENV_4$ in accordance with the tone range, depression speed or strength of the depressed key and the operated states of the control knobs in the control knob circuit 15.

Modified examples of the tone signal generation device according to the invention will be described with reference to FIGS. 4, 5 and 6. In these figures in which illustration of the circuits for generating the various coefficients $E_1$–$E_4$ are omitted, it is assumed that these coefficients are generated in response to the key scaling information, touch data, envelope signals and control knob information.

Figure 4:
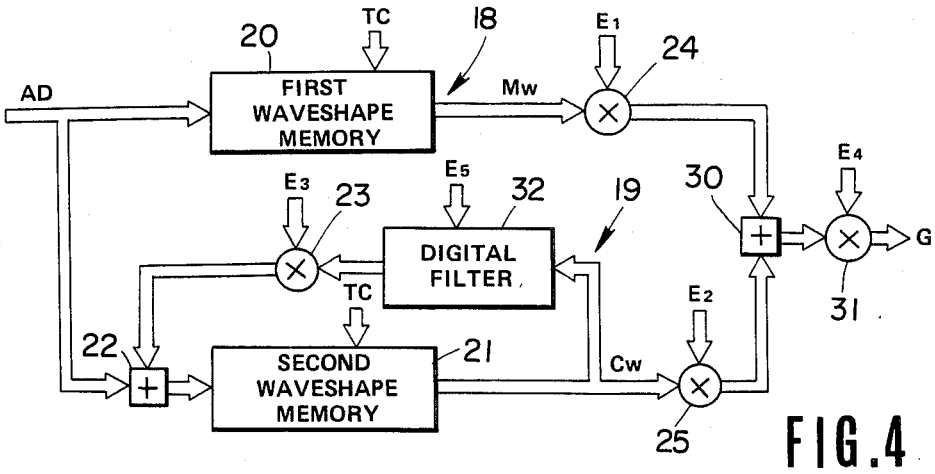
FIGS. 4, 5 and 6 show other embodiments of the invention respectively showing modified examples of the tone generator of FIG. 1.

The circuitry shown in FIG. 4 includes, as the tone color changing means of the modification waveshape generation means 19, a feedback loop including a multiplier 23 and an adder 22 for modulating the address signal as in the circuitry shown in FIG. 1 and further includes a digital filter 32 in this feedback loop. The digital filter 32 may be provided either on the input side of the multiplier 23 or on the output side thereof. Frequency-amplitude characteristics of this filter 32 are variably controlled by a filter control coefficient $E_5$. By this filter controlling, the harmonic components of a signal fed back from the output side of the second waveshape memory 21 to the input side thereof are controlled whereby further control of the tone color change is effected.

Figure 5:
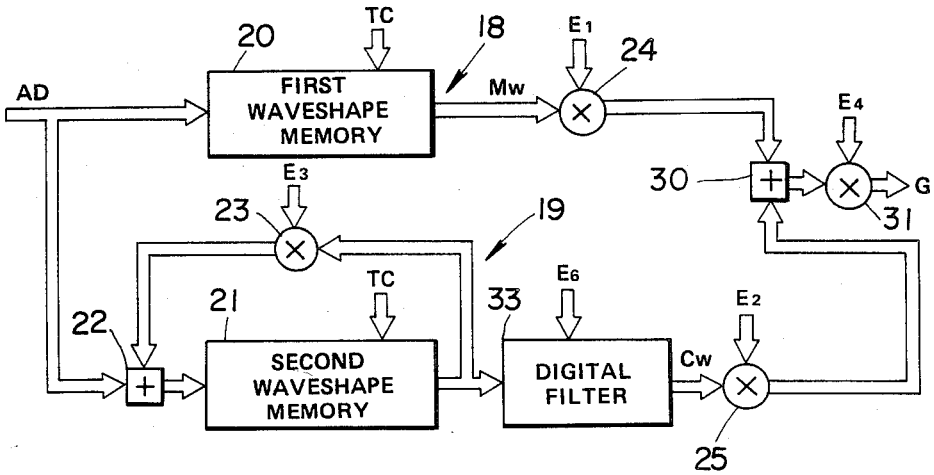

FIG. 5 shows a modified example in which, as the tone color changing means of the modification waveshape generation means 19, a digital filter 33 is further provided aside from a feedback type frequency modulation circuit consisting of a multiplier 23 and an adder 22 as in the circuitry of FIG. 1. This filter 33 may alternately be provided on the output side the multiplier 25. Frequency-amplitude characteristics of this filter 33 are controlled by a filter control coefficient $E_6$. By this controlling, the harmonic components of the modification waveshape signal are controlled and the tone color change is further controlled.

Figure 6:
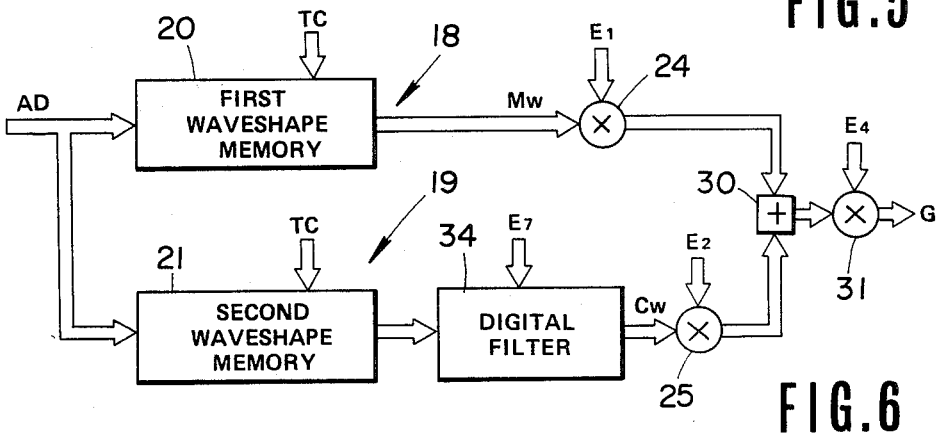

FIG. 6 shows a modified example of the tone signal generation device in which, as the tone color changing means of the modification waveshape generation means 19, a digital filter 34 is provided on the output side of the waveshape memory 21. Frequency-amplitude characteristics of the filter 34 are controlled by a filter control coefficient $E_7$. By this controlling, the harmonic components of the modification waveshape signal read out from the second waveshape memory 21 are controlled and the tone color change thereby is controlled.

The adder 22 for modulating the address signal may be substituted by other type of operation circuit such as a subtractor and the multiplier 23 for controlling the amount of the feedback may be also substituted by other type of operation circuit.

In the above described embodiments, description has been made on the assumption that the first waveshape memory 20 stores a full waveshape from rise (start of sounding) to fall (end of sounding) of a tone. Alternatively, the waveshape memory may store a full waveshape of the rise portion and a part of subsequent waveshape of a tone. The same applies to the second waveshape memory 21. Instead of storing waveshape data of all sample points in a waveshape to be generated, the respective waveshape memories may store waveshape data of skipped sample points only and waveshape data of intermediate sample points may be calculated by an interpolation operation. Waveshape of plural periods to be stored in the respective waveshape memories need not necessarily be continuous plural periods but may be skipped periods. For example, an arrangement may be made such that a tone waveshape from its rising to decaying are divided into several frames and representative waveshape data of waveshapes of one or two periods for each of these frames are stored and such waveshape data is repeatedly read out one waveshape data after another. Further, if necessary, in switching of waveshape data, a smoothly changing waveshape may be formed by interpolating interval between a preceding waveshape and a subsequent waveshape. Further, as disclosed in Japanese Preliminary Patent Publication No. 142396/1983, waveshape data of a tone waveshape for plural periods only may be stored and this waveshape data may be repeatedly read out. By such arrangement, the capacity of a waveshape memory can be further reduced.

The method for coding waveshape data to be stored in the waveshape memory is not limited to the above-described PCM system but other suitable methods such as the difference PCM (DPCM) method, delta modulation (DM) system, adapted PCM (ADPCM) system and adapted delta modulation (ADM) system may be used. In that case, in the basic tone signal generation means or the modification waveshape generation means, not only waveshape memory but also a demodulation circuit for demodulating the output read out from the waveshape memory (i.e., obtaining a pulse-code-modulated signal) according to the employed coding method is provided.

In the above embodiments, the coefficient generation circuit is of such a construction as to respond to all of the key scaling information, envelope signals, touch data operator information and tone color selection information. Alternatively, the coefficient generation circuit may respond only to a part of such information. The characteristic curves shown in FIG. 3 are only exemplary and any other suitable curves may be formed depending upon the tone color and other factors.

In the above embodiments, the address signal for reading out waveshape data in the waveshape memory is formed by counting the note clock signal. The address signal may instead be formed by accumulating or adding or subtracting frequency information corresponding to the tone pitch of a depressed key. Depending upon the construction of the waveshape memory, the address signal may remain to be the note clock signal instead of being converted into a binary code. In the case where the waveshape memory stores waveshape data with respect to each tone pitch, the address signal may be generated at a changing rate which is common to all tone pitches.

In the above embodiments, a tone is generated applying the present invention to its entire period from the rise to the fall thereof. A tone may be generated applying the invention to only a part of period (e.g., the attack portion or a connecting portion after the attack portion). Memory system or data format of the first and second waveshape memories may be the same or different from each other.

In the above described embodiments, single modification waveshape generation means 19 is provided. This means 19 may however be provided in plural channels.

In the above embodiments, the basic tone signal Mw and modification waveshape signal Cw are electrically mixed in the adder 30. Alternatively, tones corresponding to the waveshape signals Mw and Cw may be sounded from separate loud-speakers and mixed acoustically (spatially).

The present invention is applicable not only to polyphonic electronic musical instruments but also to monophonic electronic musical instruments. The invention is also applicable not only to generation of tones corresponding to scale notes but also to generation of rhythm sounds.

According to the invention, a musical tone exhibiting a desired tone color change can be generated by synthesizing a basic tone signal formed in accordance with read out output of the first waveshape memory and a modification waveshape signal formed in accordance with a read out output of the second waveshape memory upon weighting these signals at a ratio corresponding to tone color change parameters. Accordingly, notwithstanding the fact that only a single high-quality waveshape is stored in the first waveshape memory, similar high-quality waveshapes can be realized with various tone colors (i.e., tone color change depending upon the key touch or tone pitch of the depressed key or other tone color changing factors) on the basis of the single stored waveshape. Consequently, such tone color change of high-quality can be achieved with a relatively small and inexpensive construction.

I claim:

1. A tone signal device comprising:

basic tone signal generation means comprising a first waveshape memory for storing basic waveshape data representing a basic waveshape having plural periods and tone color which varies with time, said basic waveshape being formed from a part or plural parts of a full tone waveshape representing a musical tone from the start of sounding of the tone to the end thereof, and for generating a basic tone signal in accordance with said basic waveshape data read out from said first waveshape memory;

modification signal generation means comprising a second waveshape memory for storing modification waveshape data representing a modification waveshape having plural periods and tone color which varies with time, and for generating a modification signal in accordance with said modification waveshape data read out from said second waveshape memory;

weighting means for weighting said basic tone signal and said modification signal by individually using separate weighting coefficients;

weighting coefficient generation means for generating said separate weighting coefficients in response to tone color change parameters; and combining means for combining said weighted basic tone signal and weighted modification signal to produce a modified tone signal.

2. A tone signal generation device as defined in claim 1 wherein said modification waveshape generation means comprises tone color changing means for changing said modification waveshape in response to the tone color change parameters.

3. A tone signal generation device as defined in claim 1 wherein said tone color change parameters designate changing of the tone pitch or tone range of the tone to be generated.

4. A tone signal generation device as defined in claim 1 wherein said tone color change parameters designate changing of the tone color in accordance with degree of touch applied to a key for designating the tone to be generated.

5. A tone signal generation device as defined in claim 1 wherein said tone color change parameters designate changing of the tone color in accordance with an operated state of a control knob.

6. A tone signal generation device as defined in claim 2 wherein said tone color changing means comprises feedback means for feeding back the output signal of said second waveshape memory at a rate corresponding to said tone color change parameters and modulation means responsive to a fed back signal for modulating an address signal used for accessing said second waveshape memory.

7. A tone signal generation device as defined in claim 6 wherein said feedback means comprises a digital filter whose frequency-amplitude characteristics are controlled in response to said tone color change parameters in the feedback loop.

8. A tone signal generation device as defined in claim 2 wherein said tone color changing means comprises a digital filter for filtering said modification waveshape signal, and the frequency-amplitude characteristics of said digital filter are controlled in accordance with said tone color change parameters.

9. An electronic musical instrument comprising:

tone pitch designation means for designating a tone pitch of a tone to be generated;

basic tone signal generation means comprising a first waveshape memory for storing basic waveshape data representing a waveshape having a tone color which varies with time and having plural periods, said basic waveshape being formed from a tone waveshape which represents a musical tone from the start of sounding of the tone to the end thereof, said basic waveshape data being read out at a speed determined in accordance with the tone pitch designated by said tone pitch designation means, and for generating a basic tone signal in response to said basic waveshape data;

modification signal generation means comprising a second waveshape memory for storing modification waveshape data representing a modification waveshape having a tone color which varies with time and having plural periods, said modification waveshape data being read out at a speed determined in accordance with the tone pitch designated by said tone pitch designation means, and for generating a modification signal in response to said modification wave shape data;

tone color adjusting means for providing tone color adjusting signals;

combining means for combining said basic tone signal and said modification signal to provide a combined signal as a tone signal; and combining ratio control means for controlling, responsive to said tone color adjusting signals, a ratio of combining said basic signal and said modification signal in said combining means.

* * * * *